US005533363A

United States Patent [19]

Callisto

[11] Patent Number: 5,533,363

[45] Date of Patent: Jul. 9, 1996

[54] PIERCED EARRING CONVERTER

[76] Inventor: Sandra L. Callisto, 361 Cypress Dr., Laguna Beach, Calif. 92651

[21] Appl. No.: 178,932

[22] Filed: Jan. 7, 1994

[51] Int. Cl.[6] ..... A44C 7/00

[52] U.S. Cl. ..... 63/14.1; 63/13

[58] Field of Search ..... 63/13, 14.1, 12

[56] References Cited

U.S. PATENT DOCUMENTS

| | | | |
|---|---|---|---|
| 20,480 | 6/1858 | Carpenter . | |
| D. 155,511 | 10/1949 | Janousek . | |
| D. 189,793 | 2/1961 | Howard . | |
| D. 199,996 | 1/1965 | Pintarelli | 63/13 |
| 799,056 | 9/1905 | Huber | 63/13 |
| 2,410,914 | 11/1946 | Williams . | |
| 2,525,195 | 10/1950 | Austrin et al. . | |
| 2,610,486 | 9/1952 | McCann . | |
| 2,823,525 | 2/1958 | Crigler | 63/14.1 |
| 2,936,600 | 5/1960 | Crigler | 63/14.1 |
| 3,828,577 | 8/1974 | Haynes . | |
| 4,218,894 | 8/1980 | Tropea | 63/13 |
| 4,631,929 | 12/1986 | Hollingworth | 63/13 |
| 4,724,684 | 2/1988 | Barnett . | |
| 4,741,179 | 5/1988 | McConnell, Jr. | 63/13 |
| 4,827,738 | 5/1989 | Rothal | 63/14.1 |
| 5,050,404 | 9/1991 | Sugerman | 63/13 |
| 5,181,397 | 1/1993 | Battista | 63/12 |

FOREIGN PATENT DOCUMENTS

| | | |
|---|---|---|
| 947523 | of 1956 | Germany . |
| 956179 | of 1956 | Germany . |
| 2125973 | 12/1972 | Germany . |
| 433886 | 8/1935 | United Kingdom . |

OTHER PUBLICATIONS

Rio Grande Albuquerque "Gemstones & Beads" 1991–1992 brochure.

All Designs Ear Charms "Ear Charms" brochure 1991.

BJ's Hookers! brochure 1983.

*Primary Examiner*—Michael J. Milano

*Attorney, Agent, or Firm*—Donald E. Stout

[57] ABSTRACT

A pierced earring converter comprising a cuff sized and configured to be worn on the cartilage of the ear along the side of the ear, a hanger carried by the cuff and extending from the cuff and a mounting member carried by the hanger. The mounting member is sized and configured to receive a post of a pierced ear earring so that the pierced ear earring can be worn by a wearer who does not have pierced ears.

8 Claims, 1 Drawing Sheet

PIERCED EARRING CONVERTER

BACKGROUND OF THE INVENTION

An earring for pierced ears typically includes a decorative element, a post and an ear nut. The decorative member is mounted on the post and the post is adapted to extend through an opening pierced in a location on the ear such as the earlobe. The ear nut fastens to the post behind the earlobe to retain the post on the earlobe. Although earrings of this type are very common, their use creates a number of problems. For example, piercing of the ear is uncomfortable and the process required to prevent closing of the pierced opening is also somewhat time consuming and uncomfortable. More significantly, the pierced opening is subject to infection. Moreover, the wearer can suffer a painful injury if the earring catches on some other object and is pulled.

Another common form of earring is a clip on earring. Earrings of this type typically include a spring biased clamp which grips the earlobe. However, the clamp may be uncomfortable to wear, and if the clamping force is too low, the earring may fall off and be lost.

One attempt to solve the problems with pierced ear earrings has been to use a clip on type attachment to the earlobe and to mount an ear nut on the clip on member for receiving the post of the pierced ear earring. However, the resulting construction is subject to all of the disadvantages of clip on earrings including discomfort and the risk of loss of the earring.

SUMMARY OF THE INVENTION

This invention provides a pierced earring converter which solves the problems discussed above. With this invention, a pierced ear earring can be worn in comfort without danger of infection or risk of loss.

This invention can be embodied in a pierced earring converter which includes a cuff sized and configured to be worn on the cartilage of the ear along the side of the ear and a hanger carried by the cuff and extending from the cuff. A mounting member is carried by the hanger. The mounting member is sized and configured to receive a post of a pierced ear earring so that the pierced ear earring can be worn by a wearer who does not have pierced ears.

The cuff, which is worn along the side of the ear rather than on the earlobe, is much more comfortable to wear than either a clip on or the post of a pierced ear earring. The cuff is much less likely to become inadvertently detached from the ear than is a clip on and does not create a likelihood of infection.

The hanger may serve a decorative function and also serve to carry the mounting member. Although the mounting member may be metal, it is preferably constructed of an elastomeric material. Preferably the mounting member has an opening sized to receive a post of pierced ear earring. Alternatively, the mounting member may have no preformed opening, but rather be constructed of an elastomeric material which can be pierced by the post of the pierced ear earring.

Although the hanger can carry the mounting member in various different ways, preferably it has a mounting aperture in which the mounting member is received. In a preferred construction, the hanger includes a wire-like segment at least a portion of which forms at least a portion of a loop. In this event, the loop preferably defines the mounting aperture and the mounting member is snugly received in the loop.

The hanger can be of various different constructions and may include one or more sections. In one form of the invention, the hanger includes a first section integral with the cuff and a second section coupled to the first section for movement relative to the first section and depending from the first section. Mounting members can be carried by either or both of the sections.

The invention, together with additional features and advantages thereof may best be understood by reference to the following description taken in connection with the accompanying illustrative drawings.

DESCRIPTION OF THE PREFERRED EMBODIMENT

Figure 1:
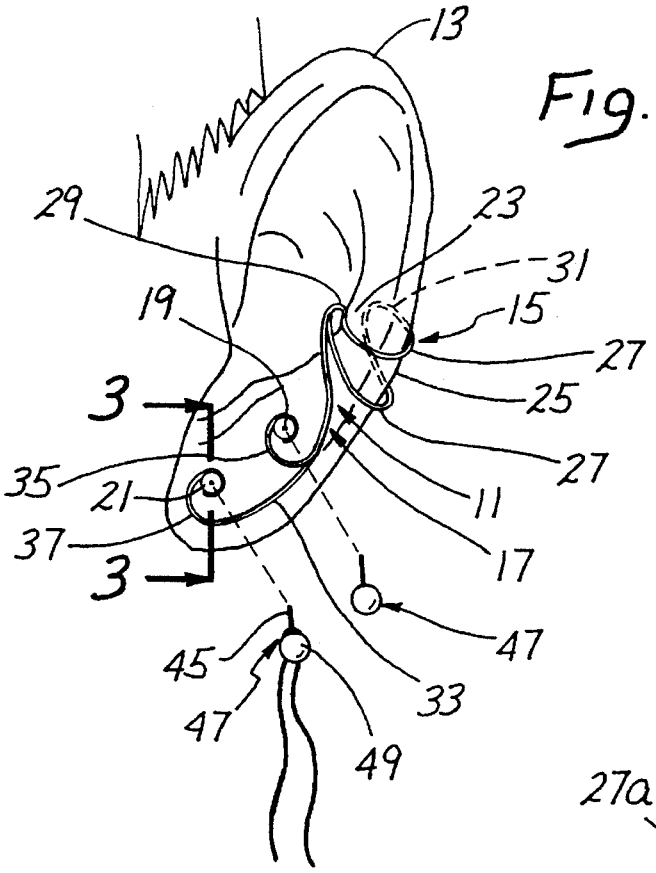
FIG. 1 is a perspective view of a converter constructed in accordance with the teachings of this invention. The converter is shown being worn on the ear of a wearer and with pierced ear earrings about to be mounted on the converter.

FIG. 1 shows a pierced earring converter 11 being worn on an ear 13. The converter 11 includes a cuff 15, a hanger 17 and two identical mounting members 19 and 21 carried by the hanger.

The cuff 15 may be of any construction so long as it is sized and configured to be worn on the cartilage 23 of the ear 13 along the side 25 of the ear. In this embodiment, the cuff 15 is of wire-like construction and is formed into a portion of a loop. The loop is open to receive a portion of the ear along the side 25 of the ear. More specifically, the loop includes two wire-like loop segments 27 which are joined together at a forward juncture 29 on the front of the ear and a back juncture 31 at the back side of the ear.

In the embodiment of FIG. 1, the hanger 17 is joined to the forward side of the cuff 15 at the forward juncture 29 and extends down along the front of the ear as shown in FIG. 1. Of course, the hanger 17 can extend from the cuff 15 in different directions and in different ways. In this embodiment, the hanger 17 is in the form of a wire-like segment. Preferably both the hanger 17 and the cuff 15 are decorative and may include, for example, a gold alloy. Cuffs such as the cuff 15 with an attached decorative member are known and any of the known ear cuffs which are sized and configured to be worn on the cartilage of the ear along the side of the ear can be employed with this invention.

More specifically, the hanger 17 includes a main section 33 coupled to the forward juncture 29 and extending generally downwardly and branch sections 35 and 37. The branch section 35 is intermediate the branch section 37 and the forward juncture 29. Each of the branch sections 35 and 37 is formed into a portion of a loop to define a mounting aperture 39 (FIG. 3) which snugly receives the mounting members 19 and 21, respectively. Although two of the mounting apertures 39 are provided, any number of mounting apertures can be provided depending upon the number of mounting members it is desired to support.

Figure 3:
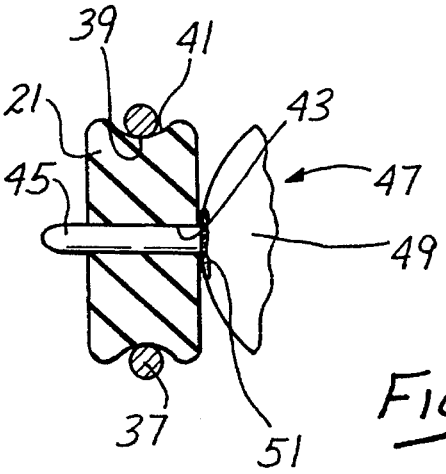
FIG. 3 is an enlarged sectional view taken generally along line 3—3 of FIG. 1 with a pierced ear earring mounted on the mounting member.

In this embodiment, the mounting members 19 and 21 are identical and only the mounting member 21 is shown in detail in FIG. 3. In the form shown in FIG. 3, the mounting member is constructed of an elastomeric material and the branch section 37 surrounds a major region of the periphery and grips it snugly so as to tightly retain the mounting member 21. This tight gripping of the elastomeric mounting member 21 creates a part annular, peripheral recess 41 in the mounting member.

The mounting member has a central opening 43 which is sized to receive a post 45 of a pierced ear earring 47. The earring 47 also includes a decorative member, such as a gemstone 49 attached to the post 45 by an attachment 51 (FIG. 3) in a conventional manner.

The opening 43 is sized to frictionally grip and retain the post 45 to thereby mount the earring 47 on the hanger 17. Thus, the hanger also serves an ear nut function. Two of the earrings 47, which are adapted for use with pierced ears, can be carried by the converter 11.

Figure 2:
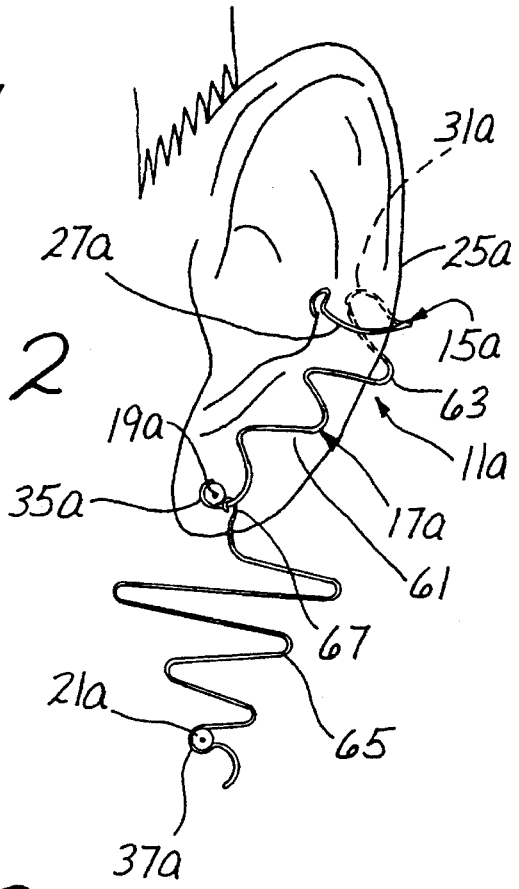
FIG. 2 is a perspective view similar to FIG. 1 illustrating a second embodiment of the invention.

FIG. 2 shows a converter 11*a* which may be identical to the converter 11 in all respects not shown or described herein. Portions of the converter 11*a* corresponding to portions of the converter 11 are designated by corresponding reference numerals followed by the letter a.

One difference between the converters 11 and 11*a* is that the cuff 15*a* has only a single loop segment 27*a* and no forward juncture 29. Rather, the hanger 17*a* includes a first section 61 integrally joined to the cuff 15*a* at a back juncture 31*a* of the hanger and cuff. The hanger 17*a* then proceeds from the back of the ear around to the front by way of a curved section 63.

The particular configuration of the first section 61 is different from the configuration of the hanger 17 to illustrate that the hanger configuration can be selected in accordance with the desires of the designer. In the embodiment of FIG. 2, the first section 61 terminates in a branch section 35*a* and mounts a mounting member 19*a* in the manner shown in FIG. 3.

The hanger 17*a* includes a second section 65 coupled to the first section for movement relative to the first section and depending from the first section. In this embodiment, the second section 65 is of decorative wire-like construction and includes an upper hook 67 for attaching the section 65 to the section 61 in a way to allow the section 65 to dangle from the section 61. A portion of the second section 61 forms a branch section 37*a* for carrying a mounting member 21*a* in the manner shown in FIG. 3. Thus, two pierced ear earrings, such as the pierced ear earrings 47 may also be mounted on the converter 11*a*.

Although exemplary embodiments of the invention have been shown and described, many changes, modifications and substitutions may be made by one having ordinary skill in the art without necessarily departing from the spirit and scope of this invention.

I claim:

1. A pierced earring converter comprising:

a cuff formed into a portion of a loop and sized and configured to be worn on the cartilage of the ear along the side of the ear;

a hanger carried by the cuff and extending from the cuff, said hanger having a mounting aperture and including a wire-like segment, at least a portion of said wire-like segment forming at least a portion of a loop and said loop defining said mounting aperture; and a mounting member snugly received in the mounting aperture of the hanger whereby the mounting member is mounted on the hanger, said mounting member being sized and configured to receive a post of a pierced ear earring whereby the pierced ear earring can be worn by a wearer who does not have pierced ears.

2. A pierced earring converter as defined in claim 1 wherein the mounting member includes an elastomeric member having an opening sized to receive a post of a pierced earring.

3. A pierced earring converter as defined in claim 1 wherein the hanger includes a first section integral with the cuff and a second section coupled to the first section for movement relative to the first section and depending from the first section, said mounting member being carried by one of said sections.

4. A pierced earring converter as defined in claim 3 wherein the second section includes a wire-like segment, at least a portion of said wire-like segment forming at least a portion of a loop and said mounting member is received in said loop.

5. A pierced earring converter as defined in claim 4 wherein the mounting member includes an elastomeric member having an opening sized to receive a post of a pierced earring.

6. A pierced earring converter as defined in claim 1 wherein the mounting member is constructed of elastomeric material.

7. A pierced earring converter as defined in claim 1 wherein the mounting member has an opening sized to receive a post of a pierced ear earring.

8. A pierced earring converter as defined in claim 1 wherein the hanger has a mounting aperture and the mounting member is received in said aperture.

* * * * *